US012624842B2

(12) United States Patent
Fitt

(10) Patent No.: US 12,624,842 B2
(45) Date of Patent: May 12, 2026

(54) OVEN APPLIANCE AND METHOD FOR FAN NOISE ADJUSTMENT

(71) Applicant: Haier US Appliance Solutions, Inc., Wilmington, DE (US)

(72) Inventor: Tyler Fitt, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 337 days.

(21) Appl. No.: 18/458,694

(22) Filed: Aug. 30, 2023

(65) Prior Publication Data

US 2025/0075919 A1 Mar. 6, 2025

(51) Int. Cl.
*F24C 15/32* (2006.01)

(52) U.S. Cl.
CPC ..... *F24C 15/322* (2013.01)

(58) Field of Classification Search
CPC ..... F24C 15/322
See application file for complete search history.

(56) References Cited

U.S. PATENT DOCUMENTS 6,555,791 B2 4/2003 Lubrina et al.
8,836,257 B2 9/2014 Savitz
2008/0066732 A1* 3/2008 Berkenkoetter .... F24C 15/2007 219/400
2010/0092275 A1* 4/2010 Savitz ..... F24C 7/08 415/1
2013/0309958 A1* 11/2013 Bach ..... G05D 7/0682 454/256
2015/0241069 A1* 8/2015 Brant ..... F24C 15/006 126/21 A
2022/0171379 A1* 6/2022 Zhou ..... G05B 19/4155
2024/0271797 A1* 8/2024 Yu ..... G01R 33/072
2024/0401831 A1* 12/2024 Lloyd ..... F24F 11/77

FOREIGN PATENT DOCUMENTS

CN 1130523 C 12/2003
KR 101298001 B1 8/2013

* cited by examiner

*Primary Examiner* — Nathan L Laughlin
(74) *Attorney, Agent, or Firm* — Dority & Manning, P.A.

(57) ABSTRACT

An oven appliance and method for operation therefor, including determining a fan speed of a fan assembly; comparing the fan speed to a lower fan speed limit; allowing adjustment of the fan speed to the lower fan speed limit when the fan speed is greater than the lower speed limit; disabling decrease of the fan speed when the fan speed is equal to the lower fan speed limit; and adjusting a control variable corresponding to operation of the flow device based on a commanded adjustment of the fan speed when the fan speed is greater than the lower speed limit, wherein adjusting the control variable corresponding to operation of the flow device decreases a fan noise from the flow device.

14 Claims, 4 Drawing Sheets

OVEN APPLIANCE AND METHOD FOR FAN NOISE ADJUSTMENT

FIELD OF THE INVENTION

The present subject matter relates generally to an oven appliance, and more particularly to an oven appliance and method for operation thereof.

BACKGROUND OF THE INVENTION

Residential and commercial oven appliances generally include a cabinet that defines a cooking chamber for receipt of food items for cooking. Heating elements are positioned within the cooking chamber to provide heat to food items located therein. The heating elements can include, for example, radiant heating elements, such as a bake heating assembly positioned at a bottom of the cooking chamber or a broil heating assembly positioned at a top of the cooking chamber. Various ovens include a fan to force a flow of hot air within the cooking chamber, such as in convection oven configurations, or a fan for force a flow of air to cool a controller.

However, operation of the fan may result in undesired noise experienced by a user. Accordingly, an oven appliance assembly that obviates one or more of the above-mentioned drawbacks would be desirable.

BRIEF DESCRIPTION OF THE INVENTION

Aspects and advantages of the invention will be set forth in part in the following description, or may be obvious from the description, or may be learned through practice of the invention.

An aspect of the present disclosure is directed to an oven appliance including a cabinet forming a cooking chamber therein, a flow device configured to selectively generate a force flow of air, and a user interface panel operably coupled to a controller. The user interface panel is configured to receive a user command and transmit the user command to the controller. The controller is configured to store instructions that, when executed by the controller, causes the oven appliance to perform operations. The operations include determining a fan speed of the flow device; comparing the fan speed to a lower fan speed limit; allowing adjustment of the fan speed to the lower fan speed limit when the fan speed is greater than the lower speed limit; disabling decrease of the fan speed when the fan speed is equal to the lower fan speed limit; and adjusting a control variable corresponding to operation of the flow device based on a commanded adjustment of the fan speed when the fan speed is greater than the lower speed limit, wherein adjusting the control variable corresponding to operation of the flow device decreases a fan noise from the flow device.

Another aspect of the present disclosure is directed to a controller for an oven appliance. The controller is configured to store instructions that, when executed, causes the oven appliance to perform operations. The operations include determining a fan speed of a flow device; comparing the fan speed to a lower fan speed limit; allowing adjustment of the fan speed to the lower fan speed limit when the fan speed is greater than the lower speed limit; disabling decrease of the fan speed when the fan speed is equal to the lower fan speed limit; and adjusting a control variable corresponding to operation of the flow device based on a commanded adjustment of the fan speed when the fan speed is greater than the lower speed limit, wherein adjusting the control variable corresponding to operation of the flow device decreases a fan noise from the flow device.

Yet another aspect of the present disclosure is directed to a method for operating an oven appliance to adjust fan noise. The method includes determining a fan speed of a fan assembly at the oven appliance; comparing the fan speed to a lower fan speed limit; allowing adjustment of the fan speed to the lower fan speed limit when the fan speed is greater than the lower speed limit; disabling decrease of the fan speed when the fan speed is equal to the lower fan speed limit; and adjusting a control variable corresponding to operation of the flow device based on a commanded adjustment of the fan speed when the fan speed is greater than the lower speed limit, wherein adjusting the control variable corresponding to operation of the flow device decreases a fan noise from the flow device.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
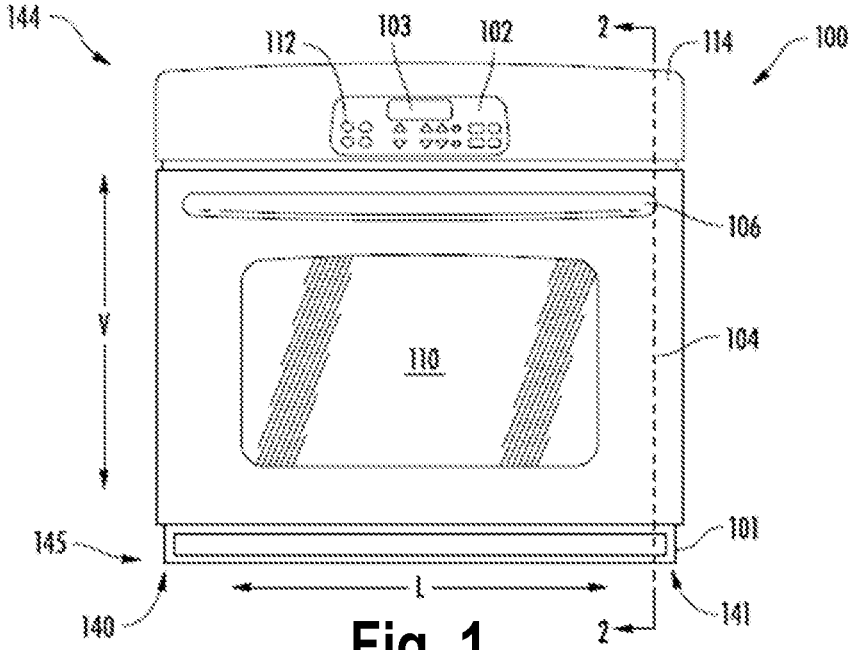
FIG. 1 provides a front view of an oven appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Embodiments of an oven appliance and method for operation are provided that may allow a user to adjust fan noise while maintaining desired function (e.g., heat transfer) of the fan during operation.

Figure 2:
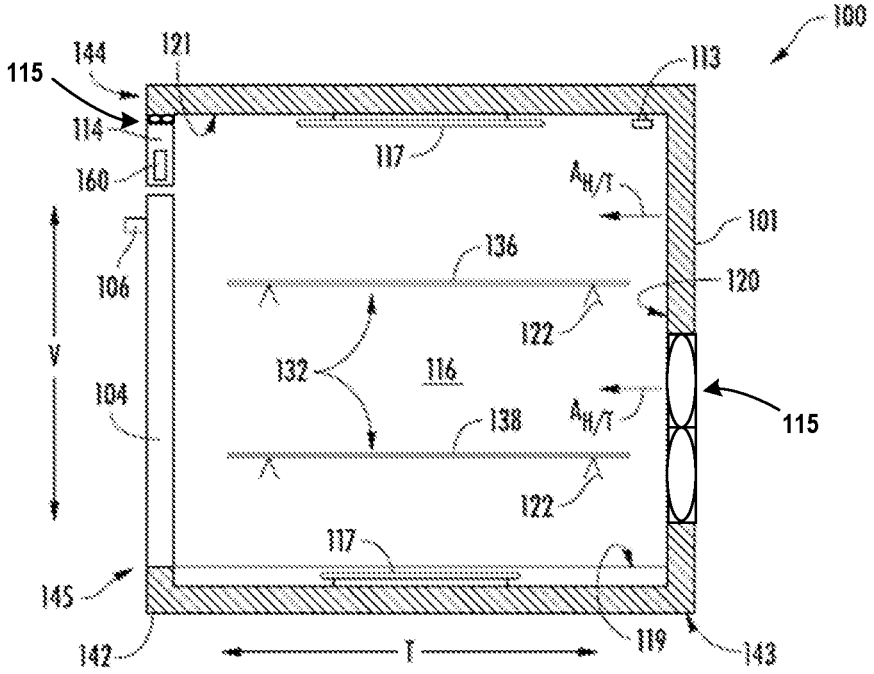
FIG. 2 provides a cross-sectional view of the oven appliance taken along the 2-2 axis of FIG. 1.
Figure 3:
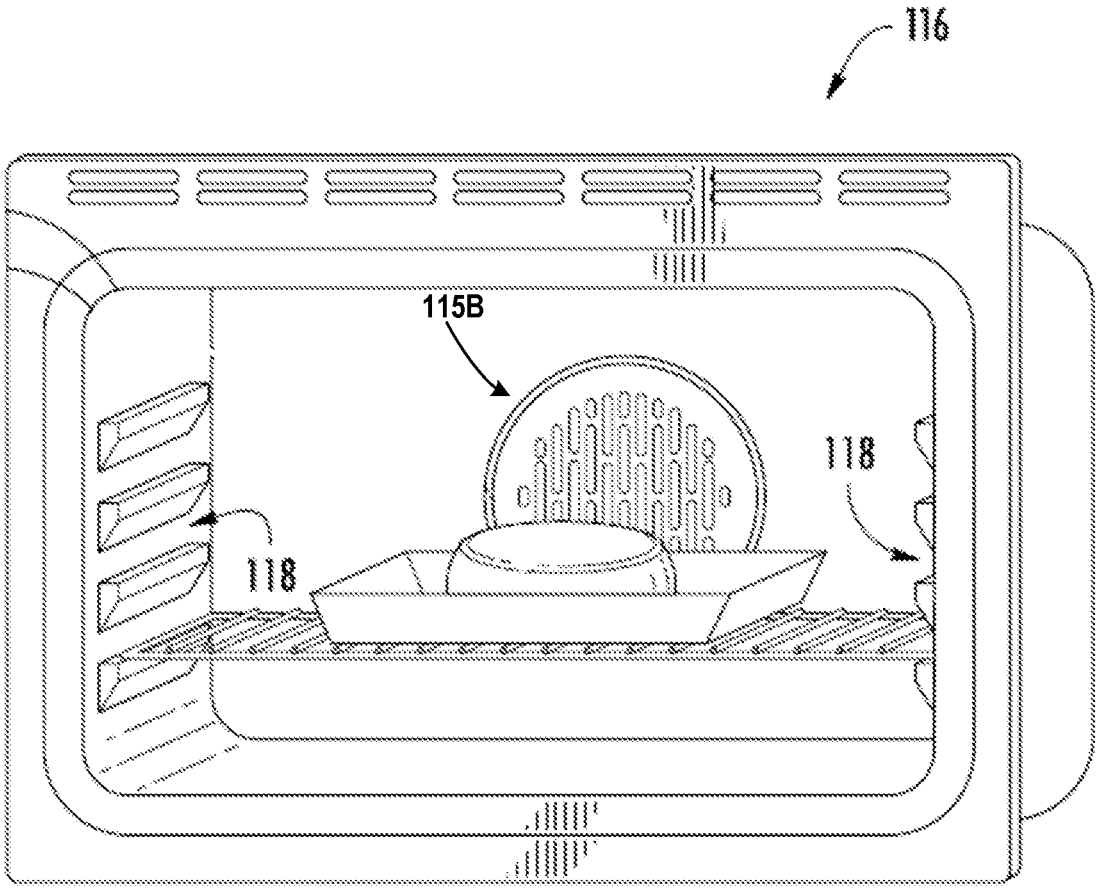
FIG. 3 provides a front, perspective view of one embodiment of an oven appliance having an adaptable port according to the present disclosure.

Referring to FIGS. 1-3, an exemplary embodiment of an oven (or cooking) appliance 100 for providing heating is shown according to the present disclosure. Although the cooking appliance shown and described herein is an oven appliance, it should be noted that the disclosure may apply to any appliance suitable for performing a cooking operation, including a microwave, a cooktop, a pizza oven, counter-top appliances, or the like. In particular, FIG. 1 provides a front view of oven appliance 100. FIG. 2 provides a cross-sectional view of oven appliance 100 taken along the 2-2 axis shown in FIG. 1. Oven appliance 100 may include a housing or cabinet 101 with a cooking chamber 116 positioned therein. FIG. 3 provides a front view of the cooking chamber 116 with a portion of the cabinet 101 removed for clarity.

Cabinet 101 extends between a first side 140 (FIG. 1) and a second side 141 (FIG. 1) along a lateral direction L. Further, cabinet 101 also extends between a front 142 (FIG. 2) and a back 143 (FIG. 2) along a transverse direction T. Cabinet 101 further extends between a top 144 and a bottom 145 along a vertical direction V. Transverse direction T is substantially perpendicular to lateral and vertical directions L. V. Thus, vertical direction V, lateral direction L, and transverse direction T are orthogonally oriented such that vertical direction V, lateral direction L, and transverse direction T form an orthogonal directional system.

Moreover, chamber 116 has interior walls including opposing sidewalls 118, bottom wall 119, back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the lateral direction L and also extends between top wall 121 and bottom wall 119 along the vertical direction V.

Sidewalls 118 may include supports 122 (FIG. 2) for supporting oven racks 132 (FIG. 2) that may be selectively positioned within chamber 116. Oven racks 132 may include a top rack 136 and a bottom rack 138. Top rack 136 is positioned above bottom rack 138 along the vertical direction V.

Oven appliance 100 may also include a door 104 with a handle 106 that provides for opening and closing access to a cooking chamber 116. A user of oven appliance 100 can place a variety of different items to be cooked in chamber 116 onto racks 132. Heating elements 117 may be positioned at the top and the bottom of chamber 116 to provide heat for cooking and cleaning. Such heating element(s) can be e.g., gas, electric, microwave, or a combination thereof. Other heating elements (not shown) could be located at other locations as well. A window 110 on door 104 allows the user to view e.g., food items during the cooking process.

Figure 4:
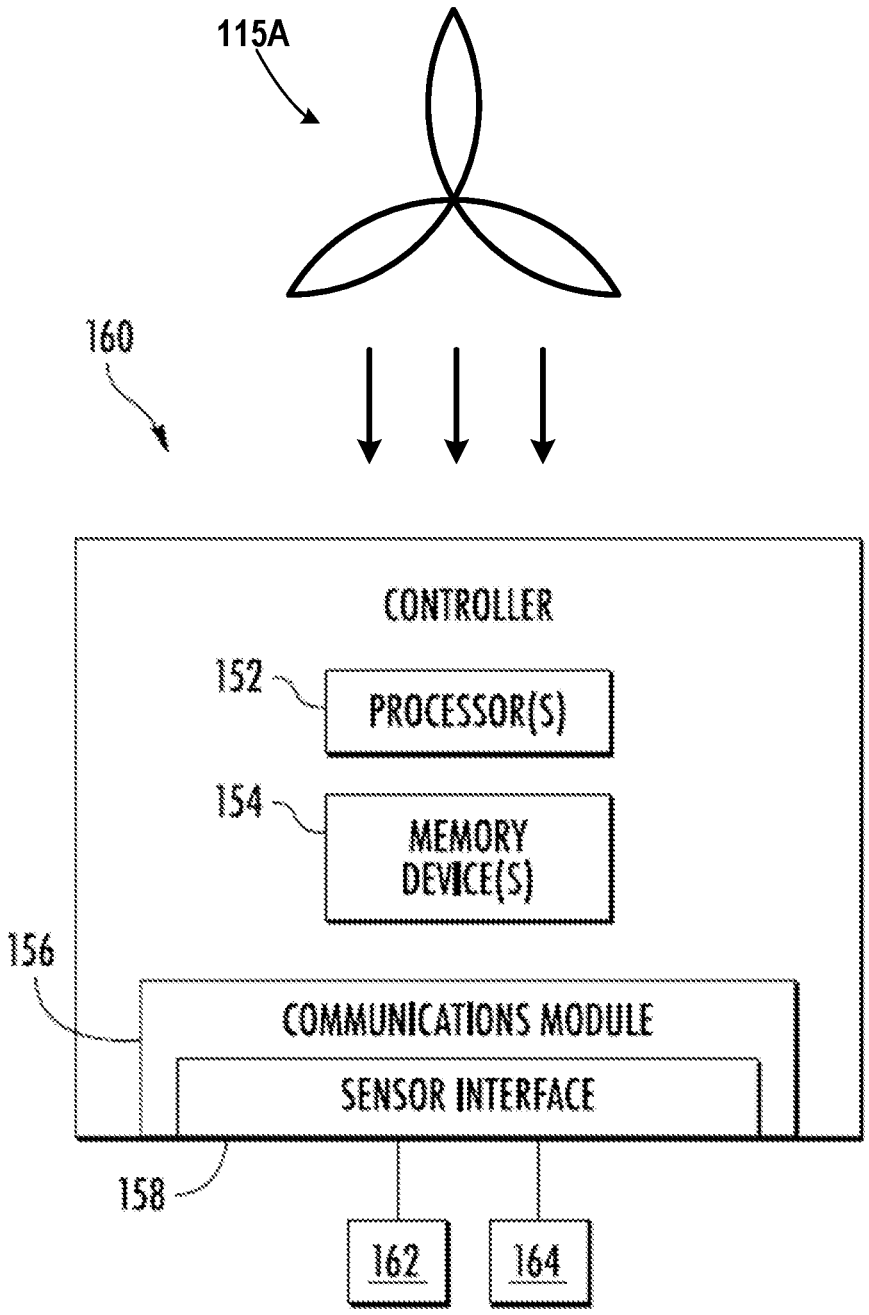
FIG. 4 provides a block diagram of one embodiment of a controller of an oven appliance according to the present disclosure.

Oven appliance 100 includes with a flow device 115, such as one or more fans. Oven appliance 100 may include the flow device 115 configured as a controller flow device 115A (FIG. 4) for selectively generating a forced flow of air for cooling a controller 160. Additionally, or alternatively, oven appliance 100 includes the flow device 115 configured as a cooking chamber flow device 115B (FIG. 3) for selectively generating a forced flow of air within the cooking chamber 116. Thus, the oven appliance 100 may generally be referred to as a convection oven. Such a flow of heated air can, e.g., decrease the required cooking temperature for food items, decrease the amount of time needed to cook food items, or assist in cooking food items more evenly. It should be appreciated that embodiments of oven appliance 100 including cooking chamber flow device 115B may form a convection oven, a microwave oven, or other cooking appliance including a flow device (e.g., a fan) for forcing a flow of heated air in the cooking chamber.

Referring to FIG. 1, oven appliance 100 may include a user interface 102 having a display 103 positioned on top panel 114 with a variety of controls 112. In certain embodiments, user interface 102 allows the user to select various options for the operation of oven appliance 100 including, e.g., temperature, time, or various cooking and cleaning cycles, and fan noise adjustment, such as further described herein. Operation of oven appliance 100 may be regulated by a controller 160 (FIG. 2) that is operatively coupled i.e., in communication with, user interface panel 102, heating element(s), and other components of oven appliance 100 as will be further described.

For example, in response to user manipulation of user interface panel 102, controller 160 may operate heating element(s). Controller 160 may receive measurements from a temperature sensor 113 (FIG. 2) placed in cooking chamber 116 and e.g., provide a temperature indication to the user with display 103. Additionally, or alternatively, as will be described in more detail below, cabinet 101 may include one or more accessory ports into which oven accessories may be plugged (e.g., via a plug). By way of example, controller 160 may include a memory and one or more processing devices such as microprocessors, CPUs, or the like, such as general or special purpose microprocessors operable to execute programming instructions or micro-control code associated with operation of appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

Controller 160 may be positioned in a variety of locations throughout appliance 100. Thus, controller 160 may be located under or next to the user interface 102 or otherwise within top panel 114. In an exemplary embodiment, input/output ("I/O") signals are routed between controller 160 and various operational components of appliance 100 such as heating element(s), controls 112, display 103, sensor(s), alarms, or other components as may be provided. In one exemplary embodiment, user interface 102 may represent a general purpose I/O ("GPIO") device or functional block.

Although shown with touch type controls 112, it should be understood that controls 112 and the configuration of the oven appliance 100 shown in FIG. 1 is provided by way of example only. More specifically, user interface 102 may include various input components, such as one or more of a variety of electrical, mechanical, or electro-mechanical input devices including rotary dials, push buttons, and touch pads. User interface 102 may include other display components, such as a digital or analog display device designed to provide operational feedback to a user. User interface 102 may be in communication with the controller 160 via one or more signal lines or shared communication busses. Also, oven appliance 100 is shown as a wall oven but the present invention could also be used with other appliances such as e.g., a stand-alone oven, an oven with a stove-top, and other configurations as well.

By way of example, as shown in FIG. 3, there is illustrated a block diagram of one embodiment of various components of controller 160 according to the present disclosure. As shown (and described briefly above), controller 160 may include one or more processors 152 and associated memory devices 154 configured to perform a variety of computer-implemented functions (e.g., such as executing programming instructions or micro-control code associated with an operating cycle). In one embodiment, processors 152 execute programming instructions stored in memory devices 154. Memory devices 154 may be separate components from processors 152 or may be included onboard within processors 152. Memory devices 154 may store information accessible to processing devices 152, including instructions that can be executed by processing devices 152. Optionally, the instructions can be software or any set of instructions that, when executed by processing devices 152, cause processing devices 152 to perform operations. For certain embodiments, the instructions include a software package configured to operate oven appliance 100 and interpret one or more electrical signals. For example, the instructions may include a software package configured to execute commands based on feedback from a probe as described more fully below.

Additionally, or alternatively, controller 160 may also include a communications module 156 to facilitate communications between controller 160 and the various components of oven appliance 100, such as flow device 115. Further, communications module 156 may include a sensor interface 158 (e.g., one or more voltage divider circuits) to permit signals transmitted from the various components of oven appliance 100, (e.g., via one or more sensors 162, 164), to be converted into signals that can be understood and processed by controller 160. It should be appreciated that the sensors 162, 164 may be communicatively coupled to communications module 156 using any suitable means. For example, as shown, sensors 162, 164 are coupled to sensor interface 158 via a wired connection. However, in other embodiments, sensors 162, 164 may be coupled to sensor interface 158 via a wireless connection, such as by using any suitable wireless communications protocol known in the art.

Furthermore, controller 160 may be positioned in a variety of locations throughout oven appliance 100. As illustrated, controller 160 may be located within user interface 102 of oven appliance 100 as shown in FIGS. 1 and 2. In such embodiments, input/output ("I/O") signals may be routed between controller 160 and various operational components of oven appliance 100, such as heating elements 117, controls 112, display 103, sensors, alarms, antennas, or other components as may be provided. For instance, signals may be directed along one or more wiring harnesses that may be routed through cabinet 101.

Figure 5:
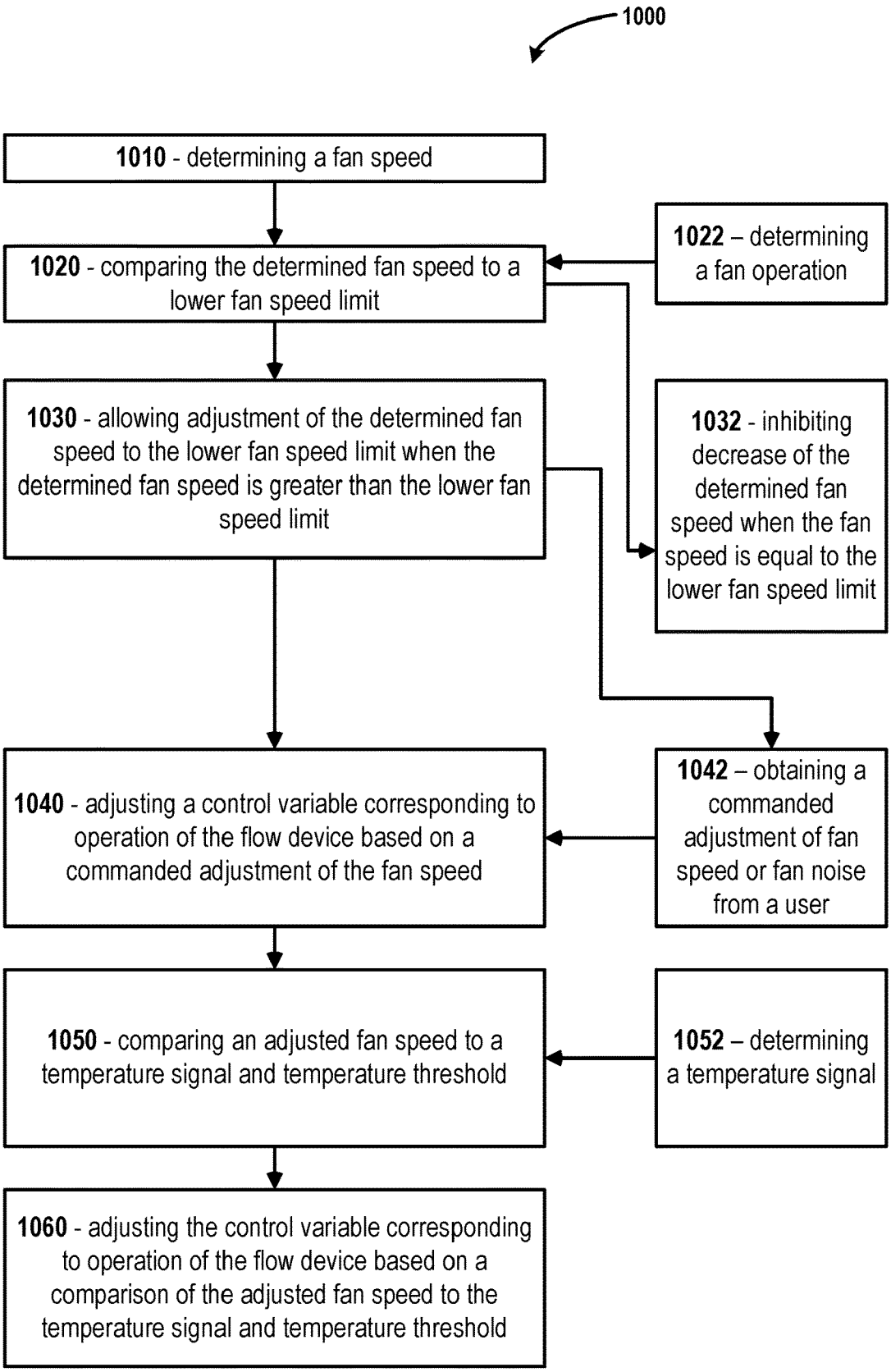
FIG. 5 provides a flow chart outlining steps of a method for fan noise adjustment at an oven appliance according to the present disclosure.

Referring now to FIGS. 5 and 6, flowcharts outlining exemplary steps of a method for operation of an oven appliance to control fan noise is provided (hereinafter, "method 1000"). Embodiments of the method 1000 may allow a user to adjust fan noise while maintaining desired function (e.g., heat transfer) of the fan during operation. Embodiments of the method 1000, or steps thereof, may be stored as instructions and executed at controller 160, such as stored at memory device 154 and executed by processor 152. It should be appreciated that steps of the method 1000 may be stored across a distributed network, such as one or more servers, external communications devices (e.g., smartphones, tablet devices, personal computers, interconnected devices, etc.), and transmitted and received by communications module 156. Still further, communications module 156 may operably couple sensors 162, 164 and flow device 115 to processor 152 and sensor interface 158, such as to receive and provide control signals in accordance with embodiments of the method 1000.

Embodiments of the method 1000 include at 1010 obtaining, measuring, or otherwise determining a fan speed. The fan speed may include a fan rotational speed, a mass or volumetric flow rate of air from operation of the flow device (e.g., flow device 115), a voltage or current draw at the flow device, or other measurement corresponding to or indicative of flow from the flow device. In some embodiments, method 1000 at 1010 includes determining a fan speed over a period of time, such as an average fan speed.

In still some embodiments, method 1000 at 1010 may be performed during operation of the flow device during a primary fan operation. The primary fan operation may include a cooking operation, such as one or more baking modes, or a cooling operation, such as for maintaining various surfaces (e.g., one or more surfaces at cabinet 101) or components (e.g., one or more components of controller 160) within desired temperature limits. Determining the fan speed may include a rolling average over the period of time during fan operation. Obtaining, measuring, or otherwise determining fan speed may include continuous sampling, or periodic measurements during the fan operation.

Method 1000 includes at 1020 comparing the determined fan speed to a lower fan speed limit. The lower fan speed limit corresponds to a minimum fan speed or flow rate for operating the flow device (e.g., flow device 115) to perform a primary fan operation.

In some embodiments, method 1000 includes at 1022 obtaining or otherwise determining a fan operation, such as the primary fan operation. Method 1000 at 1022 may include determining a lower fan speed limit relative to the fan operation. For instance, a first fan operation associated with a cooking operation, or one or more baking modes thereof, may include a first lower fan speed limit separate from a second fan operation associated with a cooling operation including a second lower fan speed limit. Accordingly, in various embodiments, method 1000 at 1020 may include comparing the determined fan speed to a lower fan speed limit corresponding relative to a fan operation.

Method 1000 includes at 1030 permitting, disinhibiting, or otherwise allowing adjustment (e.g., decrease) of the fan speed to the lower fan speed limit when the fan speed is greater than the lower fan speed limit.

Method 1000 at 1032 includes disabling or inhibiting decrease of the fan speed when the fan speed is equal to the lower fan speed limit. It should be appreciated that the oven appliance may be configured to prevent operation of the flow device below the lower fan speed limit.

Limits described herein may include ranges (e.g., +/−10%, +/−5%, +/−2%, etc.) above and/or below the lower fan speed limit. Embodiments of the method 1000 may include comparing to the upper range (e.g., +10%, +5%, +2%, etc.) or nominal of the lower fan speed limit, such as to prevent a tolerance stack-up that may result in operation below the lower limit of the lower speed limit.

Embodiments of the method 1000 may include at 1040 adjusting a control variable corresponding to operation of the flow device (e.g., flow device 115) based on a commanded adjustment of the fan speed. The control variable may include adjusting voltage or current to change fan speed. For instance, sensor 162 may be an electrical sensor configured to determine voltage or current at the flow device 115. Method 1000 at 1040 may include adjusting the control variable to correspond to decreasing the fan speed toward the lower fan speed limit when allowed via method 1000 at 1030. In various embodiments, method 1000 includes at 1042 obtaining, via a user interface (e.g., user interface 102), a commanded adjustment of fan speed or fan noise from a user, such as a manual adjustment from the user.

In various embodiments, method 1000 may include at 1050 comparing an adjusted fan speed (e.g., adjusted via step 1040) to a temperature signal and temperature threshold. For instance, sensor 164 may be a temperature sensor configured to determine temperature at cooking chamber 116 or one or more surfaces at cabinet 101, such as may be associated with the cooking operation or cooling operation. The temperature threshold may include one or more of an upper or lower limit relative to a cooling operation, an upper or limit relative to a cooking operation.

In some embodiments, method 1000 includes at 1052 obtaining, measuring, or otherwise determining the temperature signal. Determining the temperature signal may include a rolling average over the period of time during fan operation. Obtaining, measuring, or otherwise determining the temperature signal may include continuous sampling, or periodic measurements during the fan operation.

Method 1000 may include at 1060 adjusting the control variable corresponding to operation of the flow device based on a comparison of the adjusted fan speed to the temperature signal and temperature threshold. Adjusting the control variable at 1060 includes adjusting the control variable to output a second adjusted fan speed within the temperature threshold, such as based on the fan operation. For instance, method 1000 at 1060 may include increasing fan speed relative to the adjusted fan speed (e.g., the decreased fan speed at 1040 relative to the initially determined fan speed at 1010) after determining the temperature signal has drifted outside of the temperature threshold. Accordingly, step 1060 may override the commanded adjustment to the fan speed, or the adjusted fan speed, at 1040 based on the primary fan operation.

Embodiments of the oven appliance 100 and method 1000 provided herein may allow a user to shift the cooling fan speed higher or lower within a safe operating range, such as to avoid undesired or adverse cooling performance at the oven appliance. The user may allow the user to lower noise relative to a fan assembly at the oven appliance while avoiding undesired impact to baking or cooling operations. Embodiments provided herein further allow manual adjustment of fan noise (e.g., noise decrease) by the user while maintaining desired primary fan operation, such as baking or cooling at the oven appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet forming a cooking chamber therein;

a flow device configured to selectively generate a flow of air;

a user interface panel operably coupled to a controller, the user interface panel configured to receive a user command and transmit the user command to the controller, the controller configured to store instructions that, when executed by the controller, causes the oven appliance to perform operations, the operations comprising:

determining a fan speed of the flow device during a fan operation corresponding to a cooking operation or a cooling operation;

comparing the fan speed to a lower fan speed limit;

allowing adjustment of the fan speed to the lower fan speed limit when the fan speed is greater than the lower speed limit;

disabling decrease of the fan speed when the fan speed is equal to the lower fan speed limit;

obtaining, via the user interface panel, a commanded adjustment of the fan speed;

adjusting a control variable corresponding to operation of the flow device based on the commanded adjustment of the fan speed when the fan speed is greater than the lower speed limit, wherein adjusting the control variable corresponding to operation of the flow device decreases a fan noise from the flow device;

determining a temperature signal during fan operation corresponding to an adjusted fan speed corresponding to the commanded adjustment of the fan speed;

comparing the adjusted fan speed to the temperature signal and a temperature threshold, wherein the temperature threshold corresponds to an upper limit or a lower limit relative to a cooking operation or a cooling operation; and adjusting the control variable to output a second adjusted fan speed within the temperature threshold based on fan operation, wherein adjusting the control variable to output the second adjusted fan speed overrides adjusting the control variable corresponding to operation of the flow device based on the commanded adjustment of fan speed.

2. The oven appliance of claim 1, wherein determining the fan speed of the flow device comprises determining the fan speed over a period of time to determine an average fan speed.

3. The oven appliance of claim 1, wherein determining the fan speed is performed during operation of the flow device during a fan operation corresponding to a cooking operation or a cooling operation.

4. The oven appliance of claim 3, wherein comparing the fan speed to the lower fan speed limit corresponds to a minimum fan speed or flow rate for operating the flow device to perform the fan operation corresponding to the cooling cooking operation or the cooling operation.

5. The oven appliance of claim 1, the operations comprising:

determining the fan operation corresponding to the cooking operation or the cooling operation.

6. The oven appliance of claim 5, wherein determining the fan operation comprises determining the lower fan speed limit relative to the fan operation.

7. The oven appliance of claim 1, wherein adjusting the control variable corresponding to operation of the flow device comprises adjusting voltage or current to change the fan speed.

8. A controller for an oven appliance, the controller configured to store instructions that, when executed, causes the oven appliance to perform operations, the operations comprising:

determining a fan speed of a flow device, wherein determining the fan speed is performed during operation of the flow device during a fan operation corresponding to a cooking operation or a cooling operation;

comparing the fan speed to a lower fan speed limit, wherein comparing the fan speed to the lower fan speed limit corresponds to a minimum fan speed or flow rate for operating the flow device to perform the fan operation corresponding to the cooking operation or the cooling operation;

allowing adjustment of the fan speed to the lower fan speed limit when the fan speed is greater than the lower speed limit;

disabling decrease of the fan speed when the fan speed is equal to the lower fan speed limit; and adjusting a control variable corresponding to operation of the flow device based on a commanded adjustment of the fan speed when the fan speed is greater than the lower speed limit, wherein adjusting the control variable corresponding to operation of the flow device decreases a fan noise from the flow device;

determining a temperature signal during fan operation corresponding to an adjusted fan speed corresponding to the commanded adjustment of the fan speed;

comparing the adjusted fan speed to the temperature signal and a temperature threshold, wherein the temperature threshold corresponds to an upper limit or a lower limit relative to the cooking operation or the cooling operation; and adjusting the control variable to output a second adjusted fan speed within the temperature threshold based on fan operation, wherein adjusting the control variable to output the second adjusted fan speed overrides adjusting the control variable corresponding to operation of the flow device based on the commanded adjustment of fan speed.

9. The controller of claim 8, wherein determining the fan speed of the flow device comprises determining the fan speed over a period of time to determine an average fan speed.

10. The controller of claim 8, the operations comprising:

determining a fan operation corresponding to the cooking operation or the cooling operation.

11. The controller of claim 10, wherein determining the fan operation comprises determining the lower fan speed limit relative to the fan operation.

12. The controller of claim 8, wherein adjusting the control variable corresponding to operation of the flow device comprises adjusting voltage or current to change the fan speed.

13. A method for operating an oven appliance to adjust fan noise, the method comprising:

determining a fan speed of a fan assembly at the oven appliance;

comparing the fan speed to a lower fan speed limit;

allowing adjustment of the fan speed to the lower fan speed limit when the fan speed is greater than the lower speed limit;

disabling decrease of the fan speed when the fan speed is equal to the lower fan speed limit; and adjusting a control variable corresponding to operation of the flow device based on a commanded adjustment of the fan speed when the fan speed is greater than the lower speed limit, wherein adjusting the control variable corresponding to operation of the flow device decreases a fan noise from the flow device;

determining a temperature signal during fan operation corresponding to an adjusted fan speed corresponding to a commanded adjustment of the fan speed;

comparing the adjusted fan speed to the temperature signal and a temperature threshold, wherein the temperature threshold corresponds to an upper limit or a lower limit relative to a cooking operation or a cooling operation; and adjusting the control variable to output a second adjusted fan speed within the temperature threshold based on fan operation, wherein adjusting the control variable to output the second adjusted fan speed overrides adjusting the control variable corresponding to operation of the flow device based on the commanded adjustment of fan speed.

14. The method of claim 13, wherein comparing the fan speed to the lower fan speed limit corresponds to a minimum fan speed or flow rate for operating the flow device to perform the fan operation corresponding to the cooking mode or the cooling operation.

* * * * *